US006622515B2

(12) United States Patent
Baker, III

(10) Patent No.: US 6,622,515 B2
(45) **Date of Patent: *Sep. 23, 2003**

(54) INTERRUPTIBLE THERMAL BRIDGE SYSTEM

(75) Inventor: Rex Baker, III, Manhasset, NY (US)

(73) Assignee: ITB Solutions LLC, Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/045,779

(22) Filed: Oct. 26, 2001

(65) Prior Publication Data

US 2002/0121098 A1 Sep. 5, 2002

Related U.S. Application Data

(63) Continuation of application No. 09/740,300, filed on Dec. 19, 2000, now Pat. No. 6,351,952.

(51) Int. Cl.[7] ..... F25D 3/12; F28F 27/00

(52) U.S. Cl. ..... 62/383; 165/96

(58) Field of Search ..... 165/96, 165, 276, 165/277, 136, 185; 62/383

(56) References Cited

U.S. PATENT DOCUMENTS

| | | | | |
|---|---|---|---|---|
| 1,870,684 | A | 8/1932 | Killeffer | |
| 1,921,147 | A | 8/1933 | Baird | |
| 1,980,089 | A | 11/1934 | Rice, Jr. | |
| 2,346,287 | A | 4/1944 | Borgerd, et al. | |
| 2,572,715 | A | 10/1951 | Gallaugher | |
| 3,021,688 | A | 2/1962 | Winfield | |
| 3,302,703 | A | 2/1967 | Kelly | |
| 3,643,734 | A | 2/1972 | Deschamps | |
| 4,112,699 | A | 9/1978 | Hudson, III et al. | |
| 4,619,030 | A | 10/1986 | Marwick et al. | |
| 4,742,867 | A | 5/1988 | Walsh | |
| 4,858,678 | A | 8/1989 | Ladd | |
| 5,006,796 | A | 4/1991 | Burton et al. | |
| 5,867,990 | A | 2/1999 | Ghoshal | |
| 6,351,952 | B1 * | 3/2002 | Baker, III | 62/3.7 |

FOREIGN PATENT DOCUMENTS

| | | |
|---|---|---|
| FR | 2 139 624 | 1/1973 |
| GB | 1 375 434 | 11/1974 |

* cited by examiner

*Primary Examiner*—Chen Wen Jiang
(74) *Attorney, Agent, or Firm*—Bryan Cave LLP

(57) ABSTRACT

An interruptible thermal bridge system including: a first thermally conductive surface positioned proximate an object which absorbs energy; a second thermally conductive surface thermally connected to the first conductive surface positioned proximate to an object which dissipates energy, a thermal switch positioned between the first and second conductive surfaces for regulating a thermal connection between the first and second surfaces by alternatively switching between a first position, blocking the conductive path and thermally insulating the first conductive surface from the second conductive surface, and a second position, opening the conductive surface with the second conductive surface.

1 Claim, 4 Drawing Sheets

INTERRUPTIBLE THERMAL BRIDGE SYSTEM

CROSS-REFERENCE TO RELATED APPLICATION

This application is a continuation application of U.S. application Ser. No. 09/740,300, filed Dec. 19, 2000, now U.S. Pat. No. 6,351,952.

FIELD OF THE INVENTION

This invention relates to a thermal bridge system and more particularly to such a thermal bridge system which can selectively either thermally isolate or thermally connect a warm object and a cool object without any immediate/short term or long-term degradation in thermal conductivity between the objects.

BACKGROUND OF THE INVENTION

Thermoelectric chips ("TECs") chips are utilized in various cooling and heating applications. These TECs are actually miniature solid state heating/cooling devices which have no moving parts yet perform the function of drastically cooling one side of the chip while producing a proportionate increase in temperature on the other side of the chip. TECs function through what is known as the Peltier effect when current passes through the junction of two different types of conductors it results in a temperature change. Today, Bismuth Telluride is primarily used as the semiconductor material, heavily doped to create either an excess (N-type) or a deficiency (P-type) of electrons. Essentially, when a DC current passes through the junction of two wires made of dissimilar metals, the wire portions made of the first metal tend to heat up while the wire portions of the second metal tend to cool down. Correspondingly, if the current (polarity) is reversed, the heat is moved in the opposite direction. In other words, what was the hot face will become the cold face and vice a versa.

Very simply, a TEC consists of a number of P- and A-type pairs (couples) connected electrically in series and sandwiched between two ceramic plates. The cooling wire portions are all attached to a first ceramic plate (the cooling plate) and the warming wire portions are all attached to a second ceramic plate (the warming plate), where an air gap is kept between these two plates to act as an insulator. Precautionary measures are taken to insure that no water or condensation forms in between these two ceramic plates, as the water would act as a conductor and would short the heating/cooling wire portions.

When designed into systems, the warm ceramic plate of the TE chip is attached to a heat sink while the cool ceramic plate of the TE chip is attached to a device known as a cooling shoe, which absorbs latent heat from a medium. Typically, the cooling shoe is designed in a shape to accept or receive the shape of the object being cooled. For example, if the cooling shoe is designed to cool a can of soda, the cooling shoe would typically have a semicircular, concave shape so that the can of soda would fit into the cavity of the cooling shoe. This design feature is to effectively maximize surface contact, i.e. assist in cold transfer. Typical embodiments for these TE chip/heat sink/cooling shoe systems would be small-volume cooling systems, such as cooler chests or soda machines.

Thermodynamic principles mandate that the heat sink be spaced in optimal distance apart from the cooling shoe to prevent any convective heating of the cooling shoe. This optimal distance is typically two inches. Therefore, a spacer known as a bridge is typically placed between the cool ceramic plate of the TE chip and the cooling shoe. Further, rigid insulation or any other insulative material is utilized to insulate the bridge/TE chip structure so that convective heat transfer between the heat sink and the cooling shoe is minimized.

Please note that TE chips only function when a DC current is pumped through the heating/cooling wire portions within the chip. In the event of a power failure (or any other occurrence which interrupts current flow through the chip), the TE chip ceases to function as a heating/cooling device and, through conduction between the two ceramic plates via the heating/cooling wire portions, attempts to equalize the ceramic plate temperatures. Therefore, when no power is applied to the TE chip, the cooling shoe will warm up and the heat sink will cool down until they are at equal temperatures. Naturally, this is highly undesirable, as typical applications for TE chip-based cooling systems must maintain a specific temperature inside of the space being cooled. This situation is only aggravated by the fact that the power provided to these TE chips is typically cycled so that the temperature inside of the area being cooled is maintained within a predetermined range. In the event that the temperature within the area being cooled drops below the lower temperature of that predetermined range, power would then be cut to the TE chip. Unfortunately, this would result in the TE chip no longer functioning as a cooling device and actually (through conduction) equalizing the temperature of its plates and, therefore, the heat sink and cooling shoe. Accordingly, the temperature inside the cool space would immediately start to rise until that temperature exceeds the high temperature of the predetermined range. At that point in time, power to the TE chip would be cycled on and the cool space would immediately start to be cooled down. This system would continuously cycle, where the TE chip is either cooling tile space (through active cooling) or heating the space (through conductive heat transfer).

In an attempt to minimize or eliminate this undesirable situation, separation of the TE chip from either the heat sink or the bridge has been experimental and unfortunately there are several problems associated with this practice. When working with TE chips, it is imperative that a thermally efficient connection be made between the TE chip and any surface to which it is attached. Typically, a dielectric grease is utilized to connect the chip to the heat sink and the bridge. Unfortunately, by physically separating the TE chip from either the bridge or the heat sink, due to the viscous characteristics of the dielectric grease, the grease tends to stretch out in a string fashion to bridge the gap introduced between the TE chip and the body to which it is attached. Naturally, this results in a system in which the chip is not fully insulated (or isolated) from the object to which it is attached if the distance is limited. Therefore, the intended purpose of this gap (namely to thermally isolate the TE chip from either the bridge or the heat sink to prevent the equalizing of the temperatures of the cooling shoe and the heat sink) is frustrated as the thermal energy will merely transfer through these finger-like grease extrusions. Therefore, the temperature of the cooling shoe and heat sink will equalize.

Additionally, when the TE chip is placed back into position against either the bridge or the heat sink, the compression of the finger-like grease extrusions will result in the introduction of air pockets into the grease itself. These air pockets (or bubbles) act like little insulating bodies embedded within the grease, lowering the thermal efficiency of the conductive path of the heating/cooling device itself.

Another attempt to minimize the introduction of heat into the cooled area involved the use of an insulating cover placed over the heat sink, the cooling shoe, or both. If this insulating cover is placed over the heat sink, the only heat introduced into the cool area would be the latent heat stored in the heat sink itself. Alternatively, if this insulating cover is placed over the cooling shoe, limited heat gain would be introduced into the cool area. However, neither one of these situations really solves the problem at hand, as it is usually impossible to get to either the cooling shoe or heat shoe to install an insulating cover. Additionally, concerning covering either the heat sink or cold shoe with an insulating cover, this would tend to be a highly mechanical and complicated process and the net result would be insufficient.

SUMMARY OF THE INVENTION

The present invention provides a thermal bridge system comprising a first thermally conductive surface positioned proximate an object which absorbs energy and a second thermally conductive surface in thermal communication with the first conductive surface. The second surface is positioned proximate an object which dissipates energy. The thermal bridge is also equipped with a thermal switch comprising a conductive path in communication with the first thermally conductive surface and the second surface by alternatively switching between a first position, blocking at least part of the conductive path and thermally insulating the first conduction surface from the second conductive surface and a second position, opening at least part of the conductive path and thermally connecting at least part of the first conductive surface with the second conductive surface.

The advantage offered by this thermal bridge design can be shown clearly in the use of medical transportation chest. These containers are carried in automobiles, vans, planes or other vehicles. The TEC utilizes DC current provided by the vehicles battery which is continuously recharged while the vehicle is in operation. Sometimes in the course of pickup delivery it may be necessary for the vehicle to be turned off. Consequently, the TEC would contribute to an undesirable drain on the battery thereby jeopardizing the ability to restart or use the vehicle. It therefore is prudent to discontinue providing power/DC current to the TEC. The existing science of TEC Applications then create a failure of the medical box to provide a secure cold environment. The design of the present invention would provide an improved mechanism to allow the medical box to retain the coldness preferred for sensitive samples.

In one embodiment of the present invention, the switch may be an insulating cylinder having a conductive passage. The switch may also be a conductive cylinder having an insulating material covering a radial portion of the cylinder's surface. The switch may be a disk having a conductive angular portion and a non-conductive angular portion. The switch may be a sliding planar surface having a conductive portion and a non-conductive portion. The switch may be an insulting sphere having a conductive passage.

The switch may include a first switch surface positioned proximate the first conductive surface. The gapless thermal switch may also include a second switch surface positioned proximate the second conductive surface.

The interruptible thermal bridge system may include a conductive fluid positioned between the first conductive surface and the first switch surface. The conductive fluid may also be positioned between the second conductive surface and the second switch surface. The conductive fluid may be dielectric grease, a glycol-based fluid or a carbon-based fluid or any other highly conductive fluid. The interruptible thermal bridge system may include an actuator for selectively activating and deactivating the gapless thermal switch.

The interruptible thermal bridge system may include a cooling thermostat for deactivating the gapless thermal switch when the temperature proximate the cool object is above a cooling hi-point temperature which is the lowest temperature desired, thus allowing the energy absorbed by the cool object to be dissipated by the warm object. The cooling thermostat may deactivate the gapless thermal switch when the temperature proximate the cool object is below a cooling low-point temperature, thus allowing the energy absorbed by the cool object to be dissipated by the warm object. The interruptible thermal bridge system may include a heating thermostat for deactivating the gapless thermal switch when the temperature proximate the warm object is below a heating low-point temperature which is the warmest temperature in a gas range, thus allowing the energy absorbed by the cool object to be dissipated by the warm object. The heating thermostat may activate the thermal switch when tile temperature proximate the warm object is above a heating hi-point temperature, thus preventing the energy absorbed by the cool object from being dissipated by the warm object.

The present invention also provides a thermoelectric temperature control system comprising a cooling shoe positioned proximate a cool medium for absorbing energy from the cool medium and a heat sink positioned proximate a warm medium. The thermoelectric temperature control system also comprises a thermoelectric cooling device in thermal contact with and positioned proximate to the heat sink and an interruptible thermal bridge system position between the cooling shoe and the thermoelectric cooling device. The interruptible thermal bridge selectively insulates the cooling shoe from the thermoelectric cooling device.

In a preferred embodiment, the interruptible thermal bridge system may include: a first thermally conductive object having a first conductive surface, positioned proximate the cooling shoe; a second thermally conductive object having a second conductive surface thermally connected to the first conductive surface, positioned proximate the thermoelectric cooling device; and a gapless thermal switch positioned between the first and second conductive surfaces for selectively insulting the first conductive surface from the second conductive surface while maintaining a gapless connection between the conductive surfaces and the gapless terminal switch, thus selectively insulating the cooling shoe from the thermoelectric cooling device. The cool medium may be air and the system may include a first fan positioned proximate the cooling shoe for moving the cool medium over the cooling shoe to aid in the cooling shoe absorbing energy from the cool medium. The warm medium may be air and the system may include a second fan positioned proximate the heat sink for moving the warm medium over the heat sink to aid in the heat sink dissipating energy to the warm medium making the medium even warmer. The gapless thermal switch may include a first switch surface positioned proximate the first conductive surface.

The gapless thermal switch may include a second switch surface positioned proximate the second conductive surface. A conductive fluid may be positioned between the first conductive surface and the first switch surface. The conductive fluid may also be positioned between the second conductive surface and the second switch surface. The conductive fluid may be a dielectric grease, a glycol-based fluid, or a carbon-based fluid.

The thermoelectric temperature control system may include an actuator for selectively activating and deactivating the gapless thermal switch. The thermoelectric temperature control system may include a cooling thermostat for energizing the thermoelectric cooling chip and deactivating the gapless thermal switch when the temperature of the cool medium is above a cooling hi-point temperature, thus allowing the energy absorbed by the cooling shoe to be dissipated by the heat sink. The cooling thermostat may de-energize the thermoelectric cooling chip and activate the gapless thermal switch when the temperature of the cool medium is below a cooling low-point temperature, thus preventing the energy absorbed by the cooling shoe from being dissipated by the heat sink.

The thermoelectric temperature control system may include a heating thermostat for energizing the thermoelectric heating chip and deactivating the gapless thermal switch when the temperature of the warm medium is below a predetermined heating low-point temperature, whereby preventing the energy generated by the hot shoe to be dissipated by the cooling sink. The heating thermostat may de-energize the thermoelectric heating chip and activate the gapless thermal switch when the temperature of the warm medium is above a predetermined heating hi-point temperature, whereby allowing the energy absorbed by the heating shoe to be dissipated by the cold sink. Other objects, features and advantages will occur to those skilled in the art from the following description of a preferred embodiment and the accompanying drawings, in which:

DETAILED DESCRIPTION OF THE INVENTION

Figure 1:
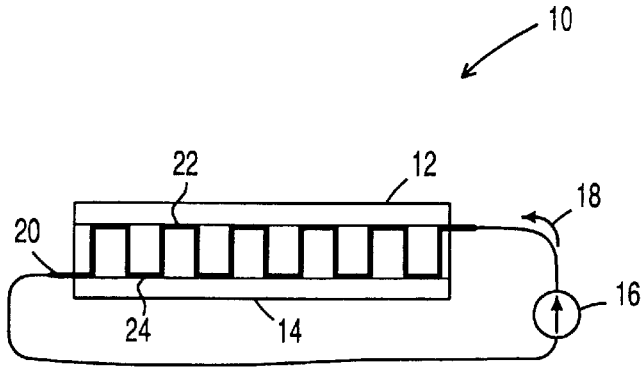
FIG. 1 is a schematic view of a thermoelectric cooling chip.

Thermoelectric chip 10, FIG. 1, includes a first ceramic plate 12 and a second ceramic plate 14. A DC Current Source 16 provides a DC current 18 which passes through conductor 20 positioned between plates 12 and 14. Conductor 20 is a bi-metal conductor which is constructed of two metals, typically Bismuth and Teluride. Conductor 20 is typically in the form of a square wave, where the portions 22 of conductor 20 that contact plate 12 are constructed of one metal while the portions 24 of conductor 20 that contact plate 14 are constructed of another metal. During use, the passage of current 18 through conductor 20 makes the upper portions 22 of conductor 20 get cool with respect to the lower portions 24 of conductor 20 which get warm. Therefore, plate 12 will be cool to the touch and plate 14 will be warm to the touch. Additionally, by changing the direction of current 18, the orientation of the warm/cool plates can be reversed.

Figure 2:
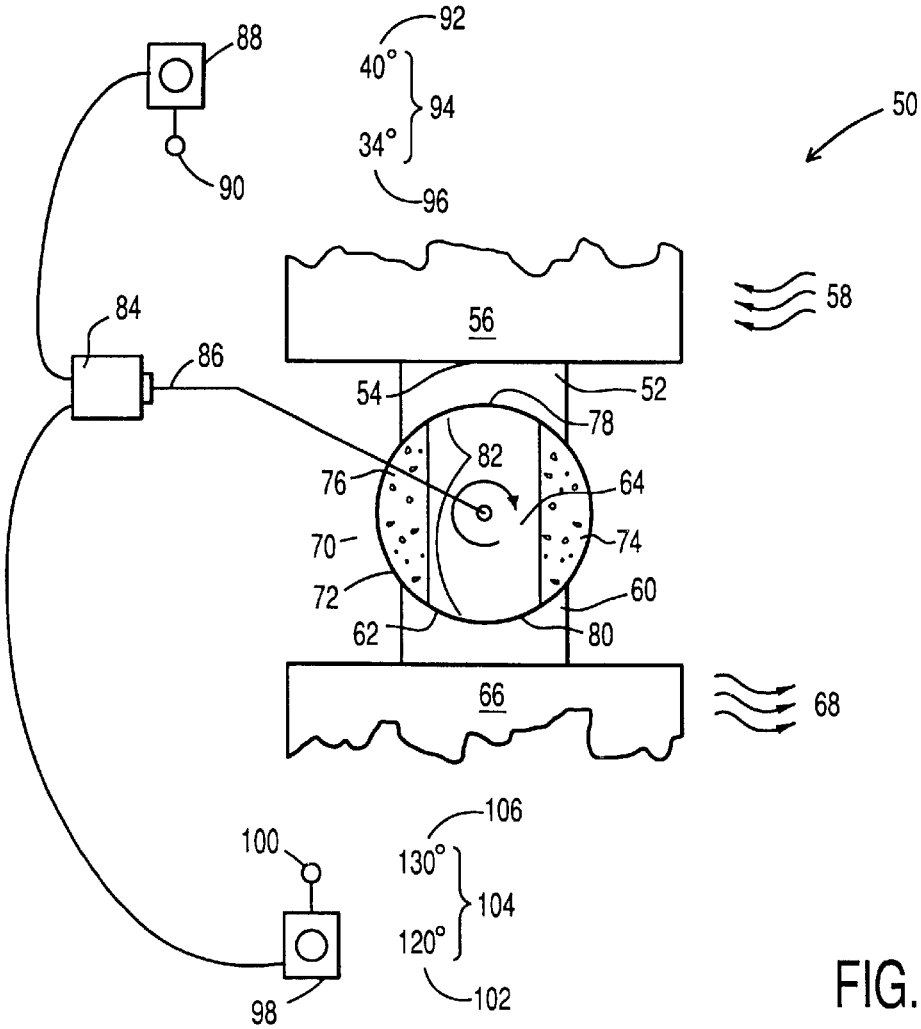
FIG. 2 is a diagrammatic view of the interruptible thermal bridge system of the present invention.

In accordance with this invention, interruptible thermal bridge system 50, FIG. 2 includes a first thermally conductive object 52 having a first conductive surface 54 positioned proximate a cool object 56 which absorbs energy 58. A second thermally conductive object 60 has a second conductive surface 62, which is thermally conducted to first conductive surface 54 through conductive passage 64, positioned proximate a warm object 66 which dissipates energy 68. Gapless thermal switch 70, which is positioned between first conductive surface 54 and second conductive surface 62 selectively insulates first conductive surface 54 from second conductive surface 62, while maintaining a gapless connection between conductive surfaces 54 and 62 and gapless thermal switch 70.

There are various ways in which gapless thermal switch 70 call be configured. For illustrative purposes only, we will first discuss the gapless thermal switch 70 which includes a conductive cylinder 72, having a conductive passage 64. Conductive cylinder 72 has an insulating material 74 covering a radial portion of the surface of cylinder 72. Additionally, a second piece of insulating material 76 can be used to cover a second radial portion of the surface of cylinder 72. Therefore, when it is desired to insulate first thermally conductive object 56 from second thermally conductive object 66, cylinder 72 can be rotated approximately 90° so that insulating materials 74 and 76 can interrupt the conductive path between objects 52 and 60. Gapless thermal switch 70 includes a first switch surface 78 positioned proximate first conductive surface 54. Gapless thermal switch 70 also includes a second switch surface 80 positioned proximate second conductive surface 62. One key aspect of this invention is the ability of the gapless thermal switch 70 to switch between: insulating first and second conductive objects 52 and 60 from each other; and thermally connecting conductive objects 52 and 60 to each other, without introducing any thermal gaps into the conductive path of interruptible thermal bridge system 50.

As fully explained in the background, the introduction of any thermal gaps (e.g., air bubbles) into the thermal path between the first and second conductive objects 52 and 60 will reduce the thermal efficiency of interruptible thermal bridge system 50. This is due to the system's reduced ability to transfer energy 58 to warm object 66 so that it can be dissipated in the form of energy 68. Through the use of precision machining and precise tolerances, first switch surface 78 maintains constant contact with first conductive surface 54 of first conductive object 52. Additionally, second switch surface 80 maintains constant contact with second conductive surface 62 of second conductive object 60. Therefore, by providing this direct "thermally-efficient" connection between conductive surfaces 78 and 80 and conductive objects 52 and 60 respectively, thermal efficiency is maximized. Additionally, as cylinder 72 of gapless thermal switch 70 is rotated, insulating materials 74 and 76 come in contact with conductive objects 52 and 60 while maintaining this contact without introducing any thermal gaps. A conductive fluid 82 may be utilized to further insure a gapless connection between switch surfaces 78 and 80 and conductive objects 52 and 60 respectively. This conductive fluid 82 may be: a dielectric grease, a glycol-based fluid or a carbon based fluid. Other types of conductive fluid call be utilized by those having ordinary skill in the art. The conductive fluid 82 may be utilized under pressure to further insure a gapless connection.

While system 50, as shown in FIG. 2, is shown as a "passive" system (in which thermal energy passively transfers from cool object 56 to warm object 66), this is for illustrative purposes only. A typical embodiment of interruptible thermal bridge system 50 would include a TE chip to create in "active" system. In this "active" configuration of interruptible thermal bridge system 50, warm object 66 would typically be ceramic plate 12, FIG. 1, of TE chip 10. As stated above, ceramic plate 12 is the cool plate of TE chip during use, energy 58 absorbed by cool object 56 would be transferred, via conductive passage 64, to cool plate 12 of TE chip 10. Alternatively, cool object 56 could be ceramic plate 14 of TE chip 10. As stated above, ceramic plate 14 is the warm plate of TE chip 10, where energy 58 provided by plate 14 is transferred, via passage 64, to warm object 66 for dissipation.

An actuator 84 and the appropriate linkage 86 can be used to selectively activate and deactivate gapless thermal switch 70. Therefore, when it is desired to prevent the transfer of thermal energy from cool object 56 to warm object 66, gapless thermal switch 70 can be activated and rotated 90° to allow insulating materials 74 and 76 to be positioned against first thermally conductive object 52 and second thermally conductive object 60. Therefore, the flow of thermal energy between these two objects is prevented, as insulating materials 74 and 76 block the thermally conductive path. Alternatively, when it is desired to transfer thermal energy from object 56 to object 66, gapless thermal switch 70 is deactivated so that: first switch surface 78 contacts first thermally conductive object 52 via fluid 82; and second switch surface 80 contacts second thermally conductive object 60 via fluid 82. This allows the transfer of thermal energy between cool object 56 and warm object 66 via conductive passage 64.

In the event that interruptible thermal bridge system 50 is utilized to maintain the temperature of the space proximate either cool object 56 or warm object 66, a thermostat may be utilized to allow for automatic actuation of gapless thermal switch 70. A cooling thermostat 88 positioned proximate cool object 56 can be used to monitor the temperature of the space proximate cool object 56. A temperature sensor 90 incorporated into cooling thermostat 88 would be used to monitor that temperature. In the event that the temperature proximate cool object 56, as monitored by temperature sensor 90, is above a predetermined high cooling set point 92 (e.g. 40° F.) in a cooling range 94, thermostat 88, via actuator 84 and linkage 86 would deactivate gapless thermal switch 70, thus allowing switch surfaces 78 and 80 to contact conductive objects 52 and 60 respectively allowing thermal energy 58 absorbed by cool object 56 to be dissipated by warm object 66 in the form of thermal energy 68. In the event that the temperature proximate cool object 56 is below a predetermined low cooling set point 96 (e.g. 34° F.), as monitored by temperature sensor 90, thermostat 88, via actuator 84 and linkage 86, will activate gapless thermal switch 70 and rotate insulating materials 74 and 76 into position proximate conductive objects 52 and 60 to essentially block the transfer of thermal energy 58 from cool object 56 to warm object 66. The predetermined high cooling set point 92 and the predetermined low cooling set point 96 may vary according to the desired temperature range to be maintained in the area adjacent to the conductive surfaces. For example, if the area to be cooled is a unit used to cool white wines, the temperature range may be 40° F. to 60° F. making the high cooling set point 92 40° F. and the low cooling set point 96 60° F.

While thus far we have discussed the interruptible thermal bridge system 50 being utilized as a cooling device, it is also possible for this system to function as a heat pump, where the temperature of the area proximate the warm object 66 is maintained by transferring energy from cool object 56. A heating thermostat 98, incorporating a temperature sensor 100, is used to monitor the temperature of the area proximate warm object 66. In the event that this temperature is below a low heating set point 102 (e.g. 120°) of heating temperature range 104, thermostat 98, via actuator 84 and linkage 86, will deactivate gapless thermal switch 70, thus positioning switch surfaces 78 and 80 proximate thermally conductive objects 52 and 60 respectively. This, in turn, allows energy 58 absorbed by cool object 56 to be transferred, via conductive passage 64, to warm object 66 so that it could be dissipated in the form of energy 68 to warm the area proximate warm object 66. Further, in the event that the temperature proximate warm object 66 is above a high heating set point 106 (e.g. 130°) of temperature range 104, thermostat 98, via actuator 84 and linkage 86, activates gapless thermal switch 70. This, in turn, rotates insulating materials 74 and 76 into a position proximate conductive objects 52 and 60 respectively, thus blocking the conductive transfer of thermal energy from cool object 56 to warm object 66.

As stated above, there are various embodiments for gapless thermal switch 70. Naturally, first thermally conductive object 52 and second thermally conductive object 60 must be reshaped and reconfigured so that they properly match the shape of the gapless thermal switch.

Figure 3A:
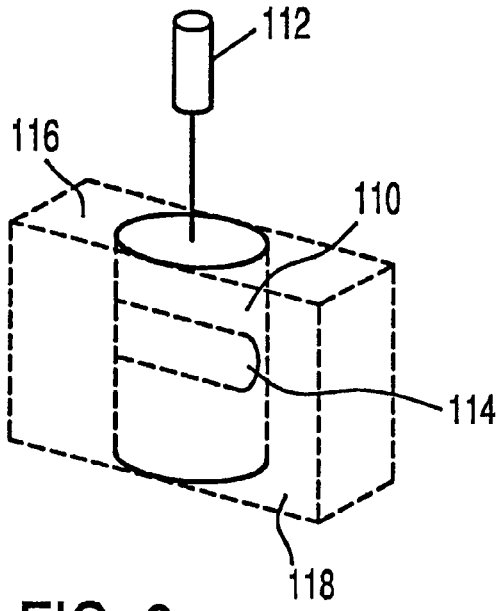
FIGS. 3*a*–3*d* are isometric views of various embodiments of the gapless thermal switch of the present invention.

The gapless thermal switch can be an insulating cylinder 110, FIG. 3*a*, which is axially rotated by actuator 112 so that conductive passage 114 either aligns with or does not align with first thermally conductive object 116 and second thermally conductive object 118 (both shown in phantom). Insulating cylinder 110 is constructed of a thermally insulating material, while conductive passage 114 is constructed of a thermally conducting material.

Figure 3B:
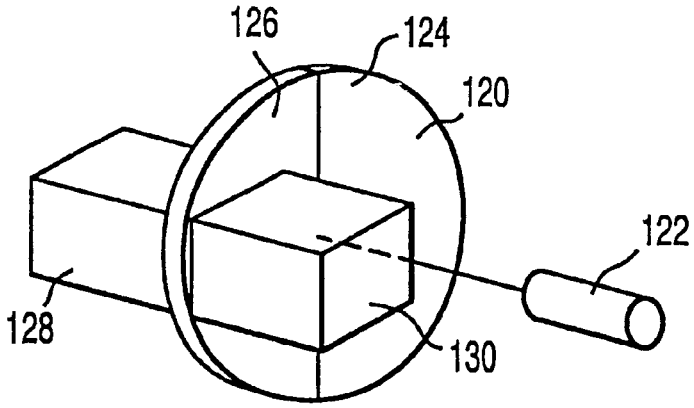

The gapless thermal switch can be a disk 120, FIG. 3*b*, which is axially rotated by actuator 122. Disk 120 has a thermally conductive angular portion 124 and a thermally insulating angular portion 126. First thermally conductive object 128 and second thermally conductive object 130 are shaped so that they provide a gapless connection between conductive objects 128 and 130 and disk 120. While disk 120 is shown as being segmented into two 180° portions, this is for illustrative purposes only and is not intended to be a limitation of the invention, as disk 120 can be segmented into as many conductive and non-conductive portions as desired.

Figure 3C:
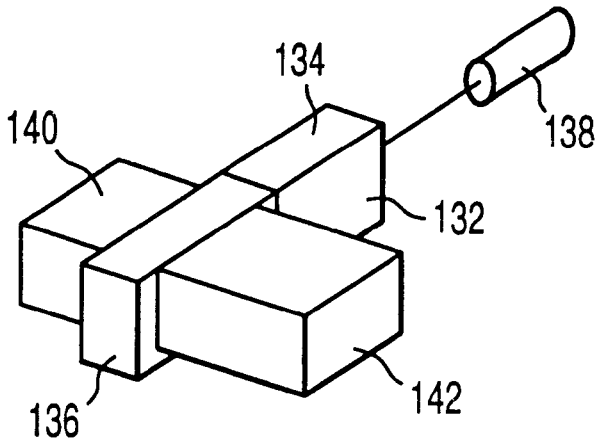
Figure 3D:
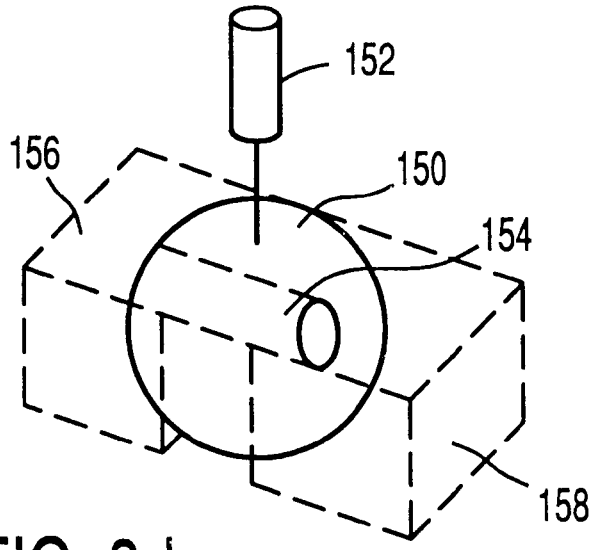

The gapless thermal switch can be a sliding planar surface 132, FIG. 3*c*, having a thermally conductive portion 134 and a thermally insulating portion 136. An actuator 138, such as a solenoid, slides planar surface 132 into the appropriate position so that either the conductive portion 134 or the insulating portion 136 of sliding planar surface 132 can be aligned with first thermally conductive object 140 and second thermally conductive object 142. Needless to say, it is important that conductive objects 140 and 142 be machined so that a gapless thermal connection can be achieved between objects 140 and 142 and sliding planar surface 132.

The gapless thermal switch can be an insulating sphere 150 which is rotated about its axis by actuator 152. A conductive passage 154 is incorporated into sphere 150 to allow thermal energy to transfer from first thermally conductive object 156 to second thermally conductive object 158. Naturally, as with all the other embodiments of the gapless thermal switch, it is important that precision tolerances be maintained so that a gapless connection can be achieved between sphere 150 and conductive objects 156 and 158 (shown in phantom)- could operate multiple paths subsequently cooling/heating multiple surfaces.

Figure 4:
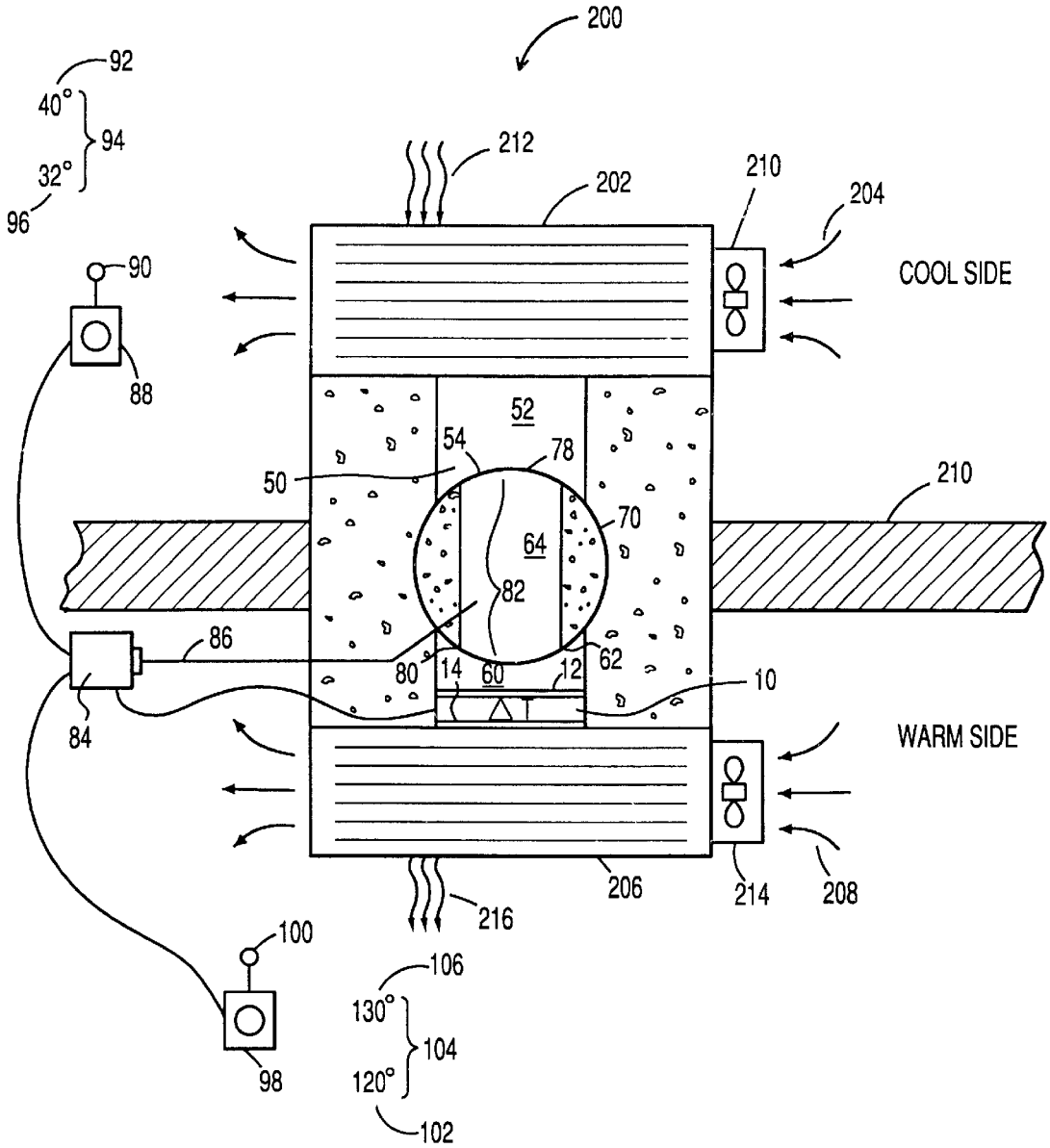
FIG. 4 is a diagrammatic view of the thermoelectric temperature control system of the present invention.

Another embodiment of invention is high efficiency thermoelectric temperature control system 200, FIG. 4, which includes a cooling shoe 202, positioned proximate a cool medium 204, for absorbing energy 212 from cool medium 204. Typically, cooling shoe 202 will be in the form of a heat sink-like device which absorbs heat from cool medium 204. Additionally, cooling shoe 202 can be custom shaped in accordance with the object or device it is designed to cool. For example, if cooling shoe 202 was designed to cool a can of soda (not shown), cooling shoe 202 would have a concave shape (in the form of a trough) so that the can of soda can rest inside of the cooling shoe and be chilled in an efficient manner. Heat sink 206, positioned proximate a warm medium 208, is used to dissipate energy 216 into warm medium 208. Therefore, thermoelectric temperature control system 200 removes thermal energy 212 from cool medium 204 and dissipates thermal energy 216 into warm medium 208.

As stated earlier, thermoelectric temperature control system 200 is typically used as a self-contained cooling/refrigeration device. Therefore, cooling shoe 202 will typically be separated from heat sink 206, as cooling shoe 202 will be on the cool side of an enclosure and heat sink 206 will be on the warm side of an enclosure, with some form of partition or enclosure wall 210 between the two. Typical embodiments of this enclosure might be the exterior wall of a soda machine or the wall of a cooler chest and may be insulated.

A TE chip 10 (as described above) is utilized in conjunction with a DC current source (not shown) which pumps a DC current through TE chip 10 so that a temperature differential (AT) is established between ceramic plates 12 and 14. TE chip 10 is in thermal contact with and positioned proximate heat sink 206. In this particular application, warm ceramic plate 14 is in direct contact with heat sink 206 and a dielectric grease (or some other form of heat transfer medium) is used to ensure that a thermally efficient connection between plate 14 and heat sink 206 is maintained. An interruptible thermal bridge system 50 (as described above) is positioned between cooling shoe 202 and TE chip 10 for selectively insulating cooling shoe 202 from TE chip 10. Concerning the connection between cool ceramic plate 12 of TE chip 10 and interruptible thermal bridge 50, a dielectric grease (not shown) is used to provide a thermally efficient connection between these two devices 12 and 50.

Interruptible thermal bridge system 50 includes a first thermally conductive object 52 which has a first conductive surface 54 positioned proximate cooling shoe 202. A second thermally conductive object 60 having a second conductive surface 62, thermally connected to first conductive surface 54 through conductive passage 64, is positioned proximate cool plate 12 of TE chip 10. Gapless thermal switch 70 is positioned between the first and second conductive surfaces 54 and 62 of thermally conductive objects 52 and 60 respectively. Gapless thermal switch 70 selectively insulates first conductive surface 54 from second conductive surface 62 while maintaining a gapless thermal connection between conductive surfaces 54 and 62 and gapless thermal switch 70, thus selectively insulating cooling shoe 202 from TE chip 10.

Cool medium 204 is typically air and thermoelectric temperature control system 200 includes a first fan 210 positioned proximate cooling shoe 202 for moving cool medium 204 over cooling shoe 202 to aid in cooling shoe 202 absorbing energy 212 from cool medium 204. Warm medium 208 is typically air and thermoelectric temperature control system 200 includes a second fan 214 positioned proximate heat sink 206 for moving warm medium 208 over heat sink 206 to aid in heat sink 206 dissipating energy 216 to warm medium 208.

Gapless thermal switch 70 includes a first switch surface 78 positioned proximate first conductive surface 54. Gapless thermal switch 70 also includes a second switch surface 80 positioned proximate second conductive surface 62. A conductive fluid 82 may be positioned between first conductive surface 54 and first switch surface 78. Additionally, the same conductive fluid 82 may be positioned between second conductive surface 62 and second switch surface 80. Conductive fluid 82 may be a dielectric grease, a glycol-based fluid, or a carbon-based fluid.

An actuator 84, in conjunction with linkage 86, selectively activates and deactivates gapless thermal switch 70. A cooling thermostat 88, via temperature sensor 90, monitors the temperature of cool medium 204. In the event that the temperature of cool medium 204, as measured by temperature sensor 90, is above a high cooling set point 92 (e.g. 40°), cooling thermostat 88 will energize TE chip 10 and deactivate gapless thermal switch 70, thus allowing the energy 212 absorbed by cooling shoe 202 to be dissipated by heat sink 206. Alternatively, if temperature sensor 90 of cooling thermostat 88 senses that the temperature of cool medium 204 is below a low cooling set point 96 (e.g. 32°), cooling thermostat 88 will deenergize TE chip 10 and activate gapless thermal switch 70, thus preventing energy 212 absorbed by cooling shoe 202 from being dissipated by heat sink 206.

Heating thermostat 98 includes a temperature sensor 100 which monitor the temperature of warm medium 208. In the event that warm medium 208 is below a low heating set point 102 (e.g. 120°), heating thermostat 98 energizes TE chip 10 and deactivates gapless thermal switch 70 so that energy 212 absorbed by cooling shoe 202 can be dissipated by heat sink 206. Alternatively, if heating thermostat 98 senses that the temperature of warm medium 208 is above a high heating set point 106 (e.g. 130°), thermostat 98 will deenergize TE chip 10 and activate gapless thermal switch 70, thus preventing energy 212 absorbed by cooling shoe 202 from being dissipated by heat sink 206.

Although specific features of this invention are shown in some drawings and not others, this is for convenience only as each feature may be combined with any or all of the other features in accordance with the invention.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiment and modes of practice.

What is claimed is:

1. A switch comprising a rotatable disk having first and second opposing disk faces, the first disk face having a conductive portion and an insulating portion so that upon rotation of the disk the conductive portion may complete a pathway of conduction for transmission of thermal energy.

* * * * *